US006052912A

United States Patent [19]

May

[11] Patent Number: 6,052,912

[45] Date of Patent: Apr. 25, 2000

[54] SPINDLE ALIGNMENT TOOL

[76] Inventor: William Jeffrey May, 821 Estey Way, Placerville, Calif. 95667

[21] Appl. No.: 09/002,422

[22] Filed: Jan. 2, 1998

[51] Int. Cl.[7] ..... B23Q 16/00

[52] U.S. Cl. ..... 33/645; 33/613; 33/568; 33/573

[58] Field of Search ..... 33/534, 645, 613, 33/549, 568, 573, 1 AA; 211/60.1; 269/910, 304; 248/316.1, 316.2, 316.4, 316.6

[56] References Cited

U.S. PATENT DOCUMENTS

| | | | |
|---|---|---|---|
| 1,049,933 | 1/1913 | Smith . | |
| 2,863,642 | 12/1958 | Pagett . | |
| 3,306,586 | 2/1967 | Green . | |
| 3,339,895 | 9/1967 | Kusel et al. . | |
| 3,590,752 | 7/1971 | De Pew | 211/60.1 |
| 3,975,000 | 8/1976 | Sado . | |
| 4,135,868 | 1/1979 | Schainholz | 211/60.1 |
| 4,272,061 | 6/1981 | Suckno . | |
| 4,901,870 | 2/1990 | Wright et al. | 211/60.1 |
| 5,337,528 | 8/1994 | Jaworski et al. . | |

*Primary Examiner*—Andrew Hirshfeld

[57] ABSTRACT

A spindle alignment tool is provided including a plurality of spindles. A pair of alignment assemblies each have multiple evenly spaced spaces formed therein. At least one interconnect bar is connected between the alignment assemblies for maintaining the same in parallel. As such, the spindles are removably situated within the spaces of the alignment assemblies for being mounted to a recipient surface in a uniform arrentation.

5 Claims, 3 Drawing Sheets

SPINDLE ALIGNMENT TOOL

BACKGROUND OF THE INVENTION

1. Field of the Invention

The present invention relates to a spindle alignment tool and more particularly pertains to attaching a plurality of spindles to a pair of rails in a uniform manner.

2. Description of the Prior Art

The use of tool templates and guides is known in the prior art. More specifically, tool templates and guides heretofore devised and utilized for various purposes are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. Nos. 5,337,528; 4,272,061; 3,339,895; 3,306,586; 1,049,933; 3,975,000; and 2,863,642.

In this respect, the spindle alignment tool according to the present invention substantially departs from the conventional concepts and designs of the prior art, and in so doing provides an apparatus primarily developed for the purpose of attaching a plurality of spindles to a pair of rails in a uniform manner.

Therefore, it can be appreciated that there exists a continuing need for a new and improved spindle alignment tool which can be used for attaching a plurality of spindles to a pair of rails in a uniform manner. In this regard, the present invention substantially fulfills this need.

SUMMARY OF THE INVENTION

In view of the foregoing disadvantages inherent in the known types of tool templates and guides now present in the prior art, the present invention provides an improved spindle alignment tool. As such, the general purpose of the present invention, which will be described subsequently in greater detail, is to provide a new and improved spindle alignment tool which has all the advantages of the prior art and none of the disadvantages.

To attain this, the present invention essentially comprises a pair of alignment assemblies. Each of such alignment assemblies include an outer and inner extent. The outer extent of each alignment assembly includes an elongated planar bottom strip with a top face, a bottom face and a periphery formed therebetween. The periphery of the bottom strip is defined by a pair of parallel linear elongated edges and a pair of parallel short edges. Each outer extent further includes an elongated planar top strip with an inboard face, an outboard face and a periphery defined by a pair of parallel elongated edges and a pair of parallel short edges. A bottom one of the elongated edges of each top strip is integrally coupled to an inboard one of the elongated edges of the bottom strip such that the bottom strip and the top strip remain in perpendicular relationship. A top one of the elongated edges of each top strip has a plurality of equally spaced and sized rectangular cut outs formed along a length thereof. For reasons that will become apparent hereinafter, each top strip has a plurality of circular apertures formed therein. Each alignment assembly further includes a pair of inner extents each including a strip with an inboard face, an outboard face and a periphery. Similar to strips of the outer extents, the periphery of the present strip is defined by a pair of parallel elongated edges and a pair of parallel short edges. A top one of the elongated edges of the strip of each inner extent has a plurality of equally spaced and sized rectangular cut outs formed along a length thereof which are similar to those of the outer extents. The strip of each inner extent further includes a plurality of elongated slots formed therein. The strip of each inner extent is slidably situated atop the bottom strip of an associated one of the outer extents. Further, each inner extent remains in general coplanar relationship with the top strip of the outer extent. As such, the inner extent and corresponding outer extent may be selectively fixed with respect to each other via a bolt fixed within one of the circular apertures and into one of the elongated slots. This allows the rectangular cut outs to be combined to define a plurality of selectively sizable spaces. As shown in FIG. 2, a pair of elongated interconnect bars each have a square cross-section along a length thereof. Each interconnect bar further has a first end with a circular bore formed therein and a second end with an elongated slot. Finally, a pair of coupling units each include a pair of bolts for being inserted within either the circular bore or elongated slot of the corresponding interconnect bar. A pair of nuts are provided for screwably engaging the associated bolt. As such, the bolts may be inserted within holes in the bottom strip of the associated outer extent and fixed thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved spindle alignment tool which has all the advantages of the prior art tool templates and guides and none of the disadvantages.

It is another object of the present invention to provide a new and improved spindle alignment tool which may be easily and efficiently manufactured and marketed.

It is a further object of the present invention to provide a new and improved spindle alignment tool which is of a durable and reliable construction.

An even further object of the present invention is to provide a new and improved spindle alignment tool which is susceptible of a low cost of manufacture with regard to both materials and labor, and which accordingly is then susceptible of low prices of sale to the consuming public, thereby making such spindle alignment tool economically available to the buying public.

Still yet another object of the present invention is to provide a new and improved spindle alignment tool which provides in the apparatuses and methods of the prior art some of the advantages thereof, while simultaneously overcoming some of the disadvantages normally associated therewith.

Still another object of the present invention is to attach a plurality of spindles to a pair of rails in a uniform manner.

Lastly, it is an object of the present invention to provide a new and improved spindle alignment tool including a plurality of spindles. A pair of alignment assemblies each have multiple evenly spaced spaces formed therein. At least one interconnect bar is connected between the alignment assemblies for maintaining the same in parallel. As such, the spindles are removably situated within the spaces of the alignment assemblies for being mounted to a recipient surface in a uniform orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
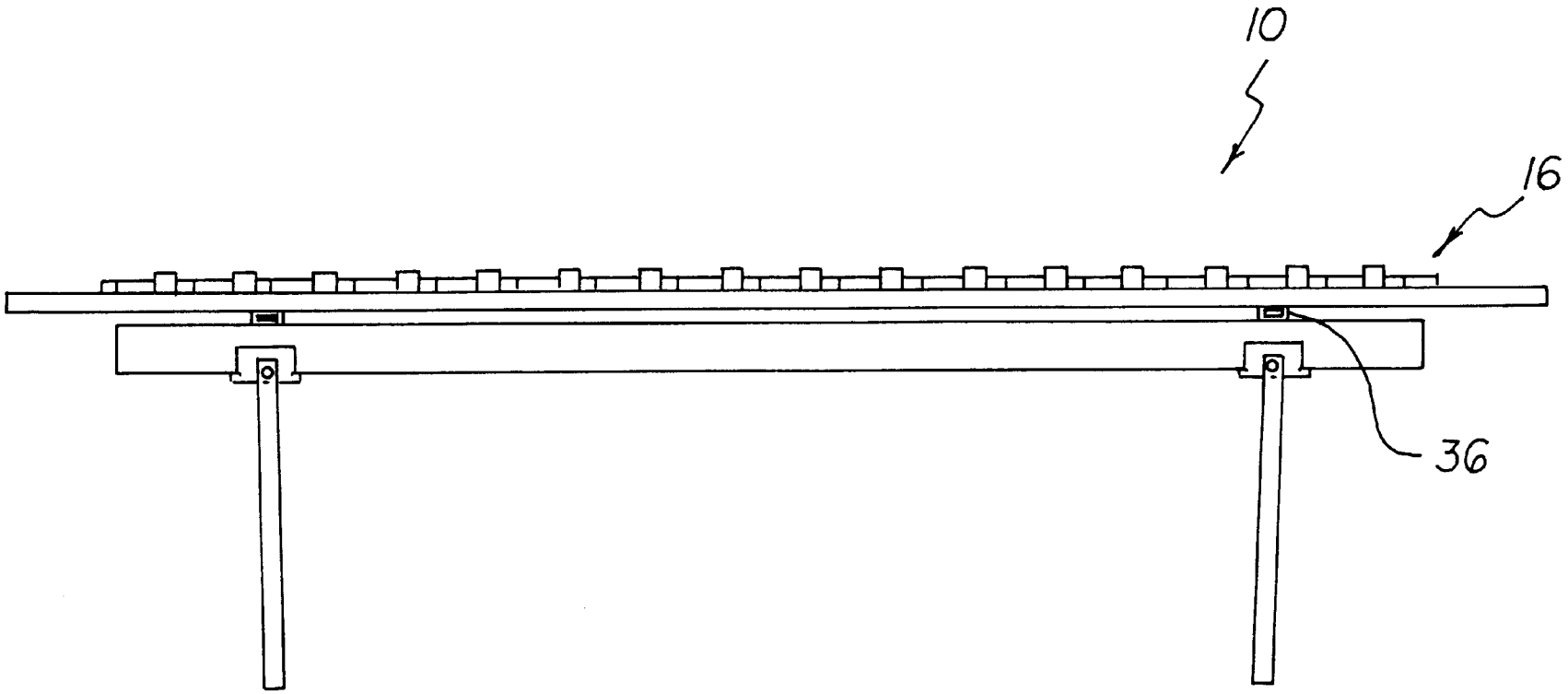
FIG. 1 is an illustration of the preferred embodiment of the spindle alignment tool constructed in accordance with the principles of the present invention.
Figure 3:
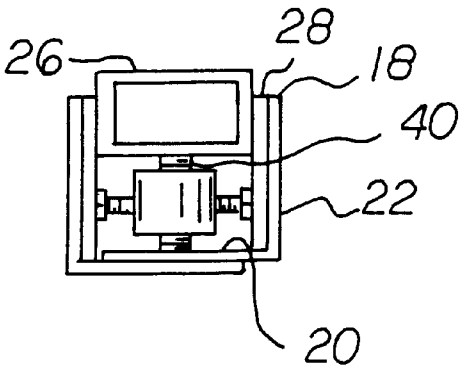
FIG. 3 is an end view of the present invention in a stored orientation.

With reference now to the drawings, and in particular to FIG. 1 thereof, a new and improved spindle alignment tool embodying the principles and concepts of the present invention and generally designated by the reference numeral 10 will be described.

The present invention, the new and improved spindle alignment tool, is comprised of a plurality of components. Such components in their broadest context include a pair of alignment assemblies and interconnect bars. Such components are individually configured and correlated with respect to each other so as to attain the desired objective.

More specifically, it will be noted that the system 10 of the present invention includes a pair of alignment assemblies 16. Each of such alignment assemblies include an outer and inner extent.

The outer extent 18 of each alignment assembly has an elongated planar bottom strip 20 with a top face, a bottom face and a periphery formed therebetween. The periphery of the bottom strip is defined by a pair of parallel linear elongated edges and a pair of parallel short edges.

Each outer extent further includes an elongated planar top strip 22 with an inboard face, an outboard face and a periphery defined by a pair of parallel elongated edges and a pair of parallel short edges. A bottom one of the elongated edges of each top strip is integrally coupled to an inboard one of the elongated edges of the corresponding bottom strip such that the bottom strip and the top strip remain in perpendicular relationship. A top one of the elongated edges of each top strip has a plurality of equally spaced and sized rectangular cut outs 24 formed along a length thereof. It is imperative that the ends of the strip not terminate in a cut out. Note FIG. 2. It should be further noted that each rectangular cut out has a height of 1 inch, or ½ that of the associated strip. For reasons that will become apparent hereinafter, each top strip has a plurality of circular apertures 26 formed therein.

Each alignment assembly further includes a pair of inner extents 28 each including a strip with an inboard face, an outboard face and a periphery. Similar to strips of the outer extents, the periphery of the present strip is defined by a pair of parallel elongated edges and a pair of parallel short edges. A top one of the elongated edges of the strip of each inner extent has a plurality of equally spaced and sized rectangular cut outs 30 formed along a length thereof which are similar to those of the outer extents. It is further preferred that a length between each rectangular cut out be equal to that of each rectangular cut out.

The strip of each inner extent further includes a plurality of elongated slots 32 formed therein. The strip of each inner extent is slidably situated atop the bottom strip of an associated one of the outer extents. Further, each inner extent remains in a slidable, general coplanar relationship with the top strip of the outer extent. As such, the inner extent and corresponding outer extent may be selectively fixed with respect to each other via a bolt fixed within one of the circular apertures of the top strip and a slot 32 associated therewith. This allows the rectangular cut outs to be combined to define a plurality of selectively sizable spaces 34. Specifically, a width of each space is adjustable.

Figure 2:
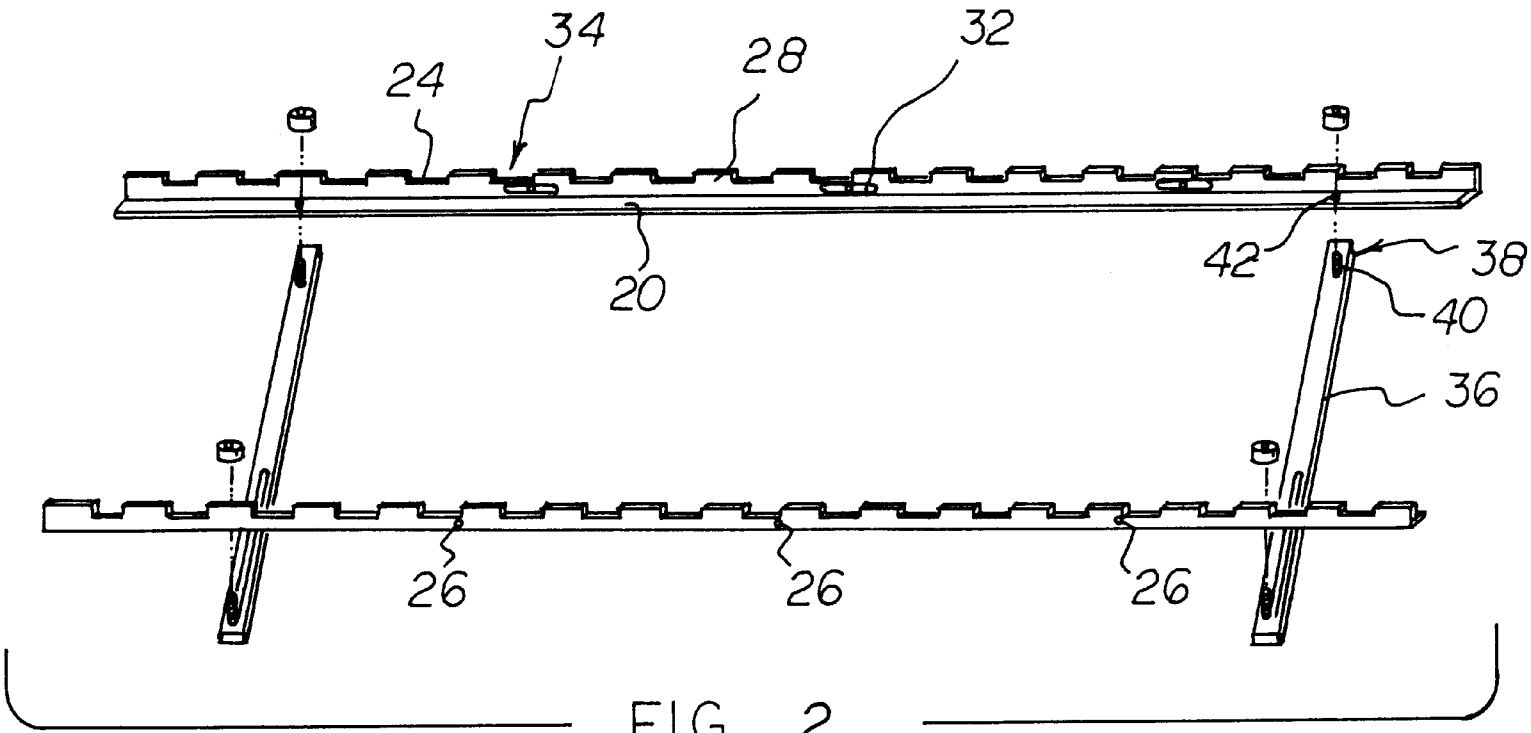
FIG. 2 is an exploded view of the present invention.
Figure 4:
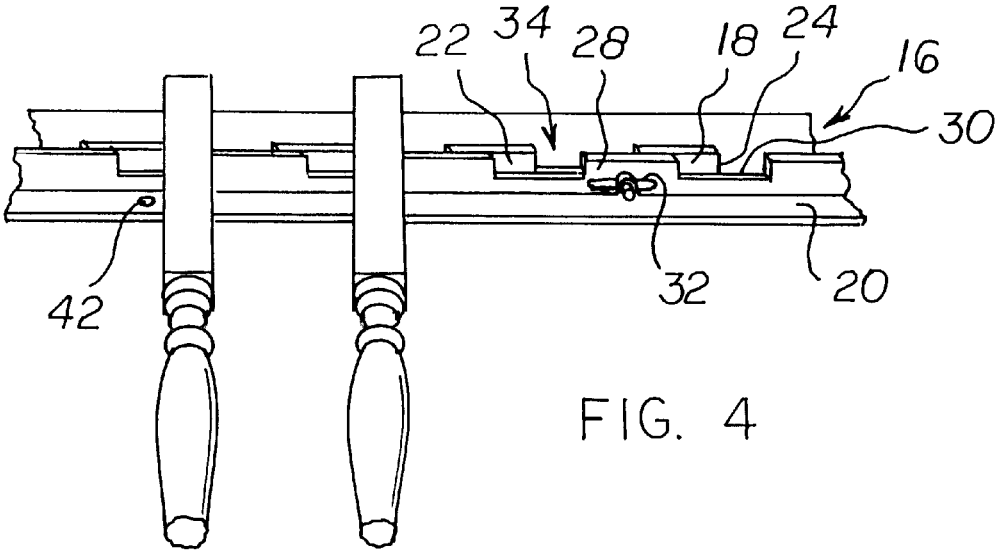
FIG. 4 is a perspective view of the present invention.
Figure 5:
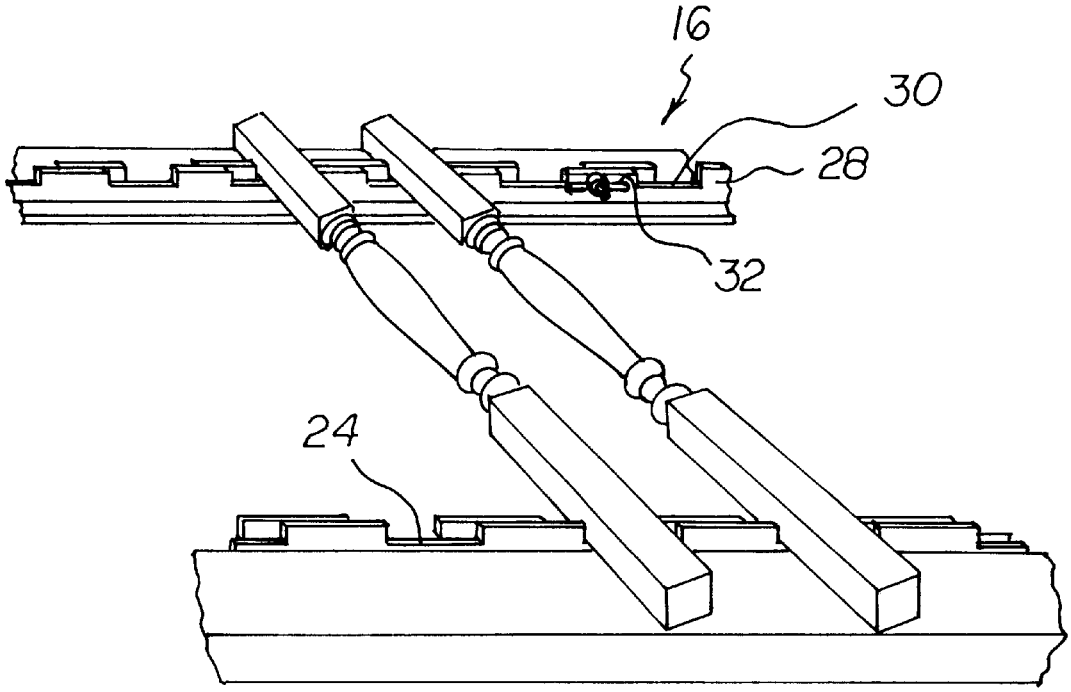
FIG. 5 is a perspective view of the present invention showing both alignment assemblies in a skewed orientation.

As shown in FIG. 2, a pair of elongated interconnect bars 36 each have a square cross-section along a length thereof. Each interconnect bar further has a first end with a circular bore formed therein. A second end is equipped with an elongated slot which spans along about ½ the length of the interconnect bar. As shown in FIG. 2, each interconnect bar has a length which is about half that of the outer and inner extents.

Finally, a pair of coupling units 38 each include a pair of bolts 40 for being inserted within either the circular bore or elongated slot of the corresponding interconnect bar. A pair of nuts are each provided for screwably engaging the associated bolt. As such, the bolts may be inserted within holes 42 in the bottom strip of the associated outer extent and fixed thereto.

During use, the outer and inner extents may be spaced in parallel a predetermined distance apart. Further, a plurality of spindles may be situated within the spaces formed by the cut outs after which the extents are slid together for securing the spindles within the spaces. As an option, the alignment assemblies may be moved such that the spindles are angled as opposed to being perpendicular with respect to a common line. When the spindles are properly positioned, all movable parts may be fixed with respect to each other so the spindles may be mounted on a pair of rails each with a uniform orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spindle alignment tool comprising:

a plurality of spindles;

a pair of alignment assemblies each having a plurality of evenly spaced spaces formed therein;

interconnect means connected between the alignment assemblies for maintaining the assemblies in parallel, whereby the spindles are removably situated within the spaces of the alignment assemblies for being mounted to a recipient surface in a uniform orientation, each of said alignment assemblies including an outer extent with an elongated planar strip having a plurality of cut outs in a top edge thereof, and an inner extent with an elongated planar strip having a plurality of cut outs in a top edge thereof, wherein said strips of said inner extents are slidably attached to an associated one of the strips of said outer extents, such that said cut outs in said inner extent strips are movable to at least partially align with said cut outs in the associated strips of said outer extents to create a plurality of selectively sizable spaces in each of the alignment assemblies, said selectively sizable spaces being said plurality of evenly spaced spaces.

2. A spindle alignment tool as set forth in claim 1 wherein the extents may be selectively fixed with respect to each other.

3. A spindle alignment tool as set forth in claim 1 wherein at least one of the alignment assemblies is slidably along the interconnect means.

4. A spindle alignment tool as set forth in claim 1 wherein the alignment assemblies are rotatable with respect to the interconnect means.

5. A spindle alignment tool comprising, in combination:

a pair of outer extents each including an elongated planar bottom strip with a top face, a bottom face and a periphery formed therebetween, the periphery of each bottom strip defined by a pair of parallel linear elongated edges and a pair of parallel short edges, each outer extent further including an elongated planar top strip with an inboard face, an outboard face and a periphery defined by a pair of parallel elongated edges and a pair of parallel short edges, a bottom one of the elongated edges of each top strip being integrally coupled to an inboard one of the elongated edges one of the bottom strip such that each bottom strip and the top strip associated therewith remain in perpendicular relationship, a top one of the elongated edges of each top strip having a plurality of equally spaced and sized rectangular cut outs formed along a length thereof, each top strip having a plurality of circular apertures formed therein;

a pair of inner extents each including a strip with an inboard face, an outboard face and a periphery defined by a pair of parallel elongated edges and a pair of parallel short edges, a top one of the elongated edges of the strip of each inner extent having a plurality of equally spaced and sized rectangular cut outs formed along a length thereof which are similar to the cut outs of the outer extents, the strip of each inner extent further including a plurality of elongated slots formed therein, wherein the strip of each inner extent is slidably situated atop the bottom strip of an associated one of the outer extents and in general coplanar relationship with the top strip thereof whereby the inner extent and corresponding outer extent are selectively fixable with respect to each other via a bolt fixed within one of the circular apertures and elongated slots thereby allowing the rectangular cut outs to be combined to define a plurality of selectively sizable spaces;

a pair of elongated interconnect bars each having a square cross-section along a length thereof, each interconnect bar further having a first end with a circular bore formed therein and a second end with an elongated slot; and a pair of coupling units each including a pair of bolts for being inserted within the circular bore and elongated slot of the corresponding interconnect bar and a pair of nuts for screwably engaging the associated bolt such that the bolts may be inserted within holes in the bottom strip of the associated outer extent, whereby the outer and inner extents may be spaced in parallel and spindles situated within the spaces for mounting the spindles on a pair of rails each with a uniform orientation.

* * * * *